US006331035B1

(12) United States Patent
Montgomery, Jr.

(10) Patent No.: US 6,331,035 B1
(45) **Date of Patent: *Dec. 18, 2001**

(54) CUTTING TOOL HOLDER ASSEMBLY WITH PRESS FIT

(75) Inventor: Robert H. Montgomery, Jr., Everett, PA (US)

(73) Assignee: Kennametal PC Inc., Monrovia, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/273,444

(22) Filed: Mar. 19, 1999

(51) Int. Cl.[7] ..... E21C 35/19

(52) U.S. Cl. ..... 299/106; 299/102; 299/79.1

(58) Field of Search ..... 299/79.1, 104, 299/100, 102, 103, 106; 279/103, 97, 102; 37/302, 450, 452, 454, 455

(56) References Cited

U.S. PATENT DOCUMENTS

| | | | | |
|---|---|---|---|---|
| 2,639,160 | * | 5/1953 | Studebaker | 279/103 |
| 2,989,295 | | 6/1961 | Prox, Jr. . | |
| 3,143,177 | | 8/1964 | Galorneau et al. . | |
| 3,174,802 | * | 3/1965 | Proctor | 299/102 |
| 3,268,260 | | 8/1966 | Snipe | 299/91 |
| 3,312,002 | * | 4/1967 | Benetti | 37/454 |
| 3,655,227 | * | 4/1972 | Orloff | 287/189 |
| 3,741,149 | * | 6/1973 | Gerlovich | 118/2 |
| 3,865,497 | * | 2/1975 | Bratt et al. | 403/15 |
| 3,871,488 | * | 3/1975 | Sabre | 175/406 |
| 4,148,368 | * | 4/1979 | Evans | 175/329 |
| 4,149,753 | | 4/1979 | Stoltz et al. | 299/91 |
| 4,251,109 | | 2/1981 | Roepke | 299/12 |
| 4,298,233 | | 11/1981 | Elfgen | 299/91 |
| 4,337,980 | | 7/1982 | Krekeler . | |
| 4,627,665 | | 12/1986 | Ewing et al. | 299/79 |
| 4,632,463 | | 12/1986 | Sterwerf, Jr. | 299/91 |
| 4,688,856 | | 8/1987 | Elfgen | 299/79 |
| 4,736,533 | | 4/1988 | May et al. | 37/141 |

(List continued on next page.)

FOREIGN PATENT DOCUMENTS

| | | |
|---|---|---|
| 2948096 | 6/1981 | (DE) . |
| 3401243 | 8/1984 | (DE) . |
| 0521413 | 6/1992 | (EP) . |
| 1033216 | 9/2000 | (EP) . |
| 729796 | 5/1955 | (GB) . |
| 2196669 | 5/1988 | (GB) . |
| 2285464 | 12/1994 | (GB) . |
| WO9839553 | 9/1998 | (WO) . |
| WO9945238 | 9/1999 | (WO) . |

OTHER PUBLICATIONS

PCT Search Report Mailed Jun. 28, 2000.
English language abstract provided.
Partial International Search Report for International Application No. PCT/US99/20668, mailed Jan. 13, 2000.
Pilkey, Walter D. Formulas for stress, strain, and structural matrices. 1994 John Wiley and Sons p. 254.*

*Primary Examiner*—David Bagnell
*Assistant Examiner*—John Kreck
(74) *Attorney, Agent, or Firm*—Kevin P. Weldon

(57) ABSTRACT

An excavation cutting tool holder includes a cutting tool holder having a holder body portion and a holder shank, the holder shank having a press fit portion and a shank bottom end, the shank press fit portion having a shank press fit dimension and the shank bottom end having a tool holder locator. The excavation cutting tool holder assembly further includes a support block having a block body, the block body having a block bore, the block bore having a block bore press fit portion and a block engagor, the block bore press fit portion having a block bore press fit dimension less than the shank press fit dimension such that the shank press fit portion press fits with the block bore press fit portion while the block engagor engages the tool holder locator so as to orient the cutting tool holder relative to the support block.

40 Claims, 1 Drawing Sheet

U.S. PATENT DOCUMENTS

| | | | | |
|---|---|---|---|---|
| 4,762,372 | * | 8/1988 | Rassmann et al. | 299/91 |
| 4,783,123 | * | 11/1988 | Ottestad | 299/94 |
| 4,938,538 | | 7/1990 | Larson et al. | 299/86 |
| 5,018,793 | | 5/1991 | DenBesten | 299/86 |
| 5,374,111 | * | 12/1994 | Den Besten et al. | 299/79.1 |
| 5,683,144 | | 11/1997 | Kammerer et al. | 299/102 |
| 5,725,283 | * | 3/1998 | O'Neill | 299/104 |
| 5,769,505 | | 6/1998 | Siddle et al. . | |
| 5,833,323 | | 11/1998 | Massa et al. . | |
| 5,842,747 | * | 12/1998 | Winchester | 299/87.1 |
| 5,884,979 | * | 3/1999 | Latham | 299/106 |
| 6,059,373 | * | 4/2000 | Wright et al. | 299/104 |
| 6,105,207 | * | 8/2000 | Muller | 15/415.1 |
| 6,176,552 | | 1/2001 | Topka, Jr. et al. | 299/104 |

* cited by examiner

CUTTING TOOL HOLDER ASSEMBLY WITH PRESS FIT

TECHNICAL FIELD

This invention relates to excavation cutting tools, and more particularly an assembly for retaining a cutting tool holder within a support block during use.

BACKGROUND ART

Excavation cutting tool assemblies for such applications as continuous mining or road milling typically comprise a cutting tool, sometimes referred to as a cutting bit, rotatably mounted within a cutting tool holder, sometimes referred to as a cutting tool sleeve, bit holder, or bit sleeve. In such assemblies, the cutting tool holder is mounted within a support block. The support block in turn is mounted onto a drum or other body, typically by welding, which in turn is driven by a suitable power means. When a number of such support blocks carrying cutting tool holders and cutting tools are mounted onto a drum, and the drum is driven, the cutting tools will engage and break up the material which is sought to be mined or removed. The general operation of such a mining machine is well known in the art.

As mentioned, the cutting tool holder may be mounted within the support block, typically via some mechanical connection. For example, U.S. Pat. No. 5,769,505 to Siddle and Massa discloses a cutting tool holder which may be connected within the support block bore via a pin threadably mounted to the support block. The portion of the pin extending into the support block bore has a generally conical shape and engages the cutting tool holder such that when the pin is rotated so as to move the pin into the block bore the conical shape will engage the cutting tool holder so as to draw the cutting tool holder into the support block bore.

SUMMARY OF THE INVENTION

An object of the invention is to provide an improved cutting tool holder assembly which allows a cutting tool holder to be assembled within a support block.

In carrying out the above object, and other objects and features of the present invention, an improved excavation cutting tool holder assembly is provided. The improved excavation cutting tool holder assembly comprises a cutting tool holder having a holder body portion and a holder shank. The holder shank has a shank press fit portion and a shank bottom end. The shank press fit portion has a shank press fit dimension. The shank bottom end has a tool holder locator. The assembly also includes a support block having a block body. The block body has a block bore. The block bore has a block bore press fit portion and a block engagor. The block bore press fit portion has a block bore press fit dimension less than the shank press fit dimension such that the shank press fit portion press fits with the block bore press fit portion while the block engagor engages the tool holder locator so as to orient the cutting tool holder relative to the support block.

In a preferred embodiment, the holder body portion of the cutting tool holder has a holder shoulder, the holder shoulder having a holder shoulder face located adjacent the block body when the cutting tool holder is press fit within the block bore of the support block, the holder shoulder face defining an undercut recess.

In another preferred embodiment, the shank has a shank tapered portion and the block bore has block bore tapered portion such that when the shank tapered portion seats within the block bore tapered portion the shank press fit portion press fits with the block bore press fit portion.

In yet another preferred embodiment, the cutting tool holder may include a striking surface.

In an alternative embodiment, the excavation cutting tool holder assembly includes a cutting tool holder having a holder body portion and a shank. The holder shank has a shank tapered portion and a shank press fit portion. The shank press fit portion has a shank press fit dimension. The assembly also includes a support block having a block body. The block body has a block bore. The block bore has a block bore tapered portion and block bore press fit portion. The block bore press fit portion has a block press fit diameter less than the holder press fit diameter such that when the shank tapered portion seats within the block bore tapered portion the shank press fit portion press fits with the block bore press fit portion.

In a preferred embodiment, the holder shank has a shank bottom end having a locator groove and the block bore has a block pin such that the block pin will engage with and slide into the locator groove so as to orient the cutting tool holder relative to the support block.

In another preferred embodiment, the holder body portion of the cutting tool holder has a holder shoulder, the holder shoulder having a holder shoulder face located adjacent the block body when the cutting tool holder is press fit within the block bore of the support block, the holder shoulder face defining an undercut recess.

In another alternative embodiment, the excavation cutting tool holder assembly includes a cutting tool holder having a holder body portion and a holder shank. The holder shank has a shank tapered portion and a holder shoulder having a holder shoulder face. The holder shoulder face defines an undercut recess. The assembly also includes a support block having a block body. The block body has a block bore. The block bore has a block bore tapered portion such that the shank tapered portion seats within the block bore tapered portion and the holder shoulder face is correspondingly located adjacent the block body.

In each of these embodiments, the tool holder locator may have a female configuration and the block engagor may have a male configuration. More specifically, the block engagor may consist of a block pin within the block bore and the tool holder locator may consist of a locator groove in the shank bottom end such that the block pin will engage with and slide into the locator groove so as to orient the cutting tool holder relative to the support block. The block pin may consist of a cylindrical pin running across the entire width of the block bore and the locator groove may have groove side walls running across the entire width of the shank bottom end.

In each of these embodiments, the undercut recess may have a top recessed surface which is inclined relative to the holder shoulder face.

Furthermore, in each of these embodiments, the shank press fit portion may be a shank cylindrical portion having a shank press fit diameter and the bore press fit portion may be a bore cylindrical portion having a block bore press fit diameter less than the shank press fit diameter such that the shank cylindrical portion press fits with the bore cylindrical portion of the block bore.

In each of these embodiments, it is preferred that the shank tapered portion be located adjacent the holder body portion and the shank press fit portion be located adjacent the shank tapered portion.

In each of these embodiments, the holder shank may also include a shank slip fit portion to guide the holder shank into the block bore. In such case, it is preferred that the shank tapered portion be located adjacent the holder body portion, the shank press fit portion be located adjacent the shank tapered portion, and the shank slip fit portion be located adjacent the shank press fit portion.

In each of these embodiments having a block engagor and a tool holder locator, the block engagor may be a pin within the block bore and the tool holder locator may be a locator groove in the shank bottom end such that the block pin will engage the locator groove so as to orient the cutting tool holder relative to the support block such that the block pin will slide into the locator groove as the cutting tool holder is press fit with the support block.

Furthermore, in each of these embodiments, the cutting tool holder may include a striking surface.

The present invention also includes an improved cutting tool holder for use with a support block having a block body, the block body having a block bore, the block bore having a block bore tapered portion, a block bore press fit portion, and a block engagor, the block bore press fit portion having a block bore press fit diameter. The improved cutting tool holder comprises a holder body portion and a holder shank having a shank tapered portion, a shank press fit portion, and a shank bottom end. The shank press fit portion has a shank press fit diameter and the shank bottom end has a tool holder locator. The shank press fit diameter is greater than the bore press fit diameter such that the shank press fit portion press fits with the bore press fit portion while the shank tapered portion seats within the block bore tapered portion and the block engagor engages the tool holder locator so as to orient the cutting tool holder relative to the support block.

In a preferred embodiment, the tool holder locator has a locator groove. In another preferred embodiment, the holder body portion has a holder shoulder, the holder shoulder having a holder shoulder face located adjacent the block body when the cutting tool holder is press fit within the block bore of the support block, the holder shoulder face defining an undercut recess, the undercut recess having a top recess surface which is inclined relative to the holder shoulder face. In yet another preferred embodiment, the cutting tool holder includes a striking surface.

The present invention also includes an improved holder pedestal portion for use with a holder block portion and a support block, the support block having a block body, the block body having a block bore, the block bore having a block bore tapered portion, a block bore press fit portion, and a block engagor, the block bore press fit portion having a block bore press fit diameter. The improved holder pedestal portion comprises a pedestal body portion connectable to the holder block portion and a holder shank having a shank tapered portion, a shank press fit portion, and a shank bottom end. The shank press fit portion has a shank press fit diameter and the shank bottom end has a tool holder locator. The shank press fit diameter is greater than the bore press fit diameter such that the shank press fit portion press fits with the bore press fit portion while the shank tapered portion seats within the block bore tapered portion and the block engagor engages the tool holder locator so as to orient the cutting tool holder relative to the support block.

In a preferred embodiment, the tool holder locator is a locator groove. In another preferred embodiment, the pedestal body portion has a holder shoulder, the holder shoulder having a holder shoulder face located adjacent the block body when the holder shank of the holder pedestal portion is press fit within the block bore of the support block, the holder shoulder face defining an undercut recess, the undercut recess having a top recess surface which is inclined relative to the holder shoulder face. In yet another preferred embodiment, the pedestal body portion includes a striking surface.

The present invention also includes an improved support block for use with a cutting tool holder having a holder body portion and a shank, the shank having a shank tapered portion, a shank press fit portion, and a shank bottom end, the shank press fit portion having a shank press fit diameter and the shank bottom end having a tool holder locator. The improved support block comprises a block body having a block bore, the block bore having a block bore tapered portion, a bore press fit portion, and a block engagor. The bore press fit portion has a bore press fit diameter less than the shank press fit diameter such that the shank press fit portion press fits with the bore press fit portion while the shank tapered portion seats within the block bore tapered portion and the block engagor engages the tool holder locator so as to orient the cutting tool holder relative to the support block.

In a preferred embodiment, the block engagor is a block pin.

The advantages resulting from this invention are numerous. For example, because the components are relatively simple in geometry, machining or milling costs typically associated with the manufacture of such components are less than typical.

Another advantage is that with this invention screws or lugs are not necessary to assemble the cutting tool holder with the support block. The cutting tool holder can be simply pushed or knocked into, and pulled or knocked out of, the block bore of the support block.

An advantage of embodiments including a cutting tool holder with a striking face is that the cutting tool holder can be struck to mount the holder shank within the block bore.

An advantage of embodiments including a shank tapered portion and a block tapered portion is that when the shank tapered portion is seated within the block bore tapered portion, the resulting "locking taper" will normally remain tightly engaged due to the cutting loads imposed in a direction from the cutting tool to the support block which will occur during normal use.

An advantage of embodiments including shank and bore press fit portions is that the press fit between the cutting tool holder and the block bore prevents the cutting tool holder from being accidentally dislodged from the support block as a result of machine vibration, impact, or reverse loading.

An advantage of embodiments including an undercut recess is that the undercut recess allows the cutting tool holder to be more easily removed from the block bore of the support block by inserting a suitable tool into the undercut recess and prying the holder shank of the cutting tool holder from the block bore of the support block. Where the undercut recess has a recess top surface which is inclined relative to the holder shoulder face of the cutting tool holder, the cutting tool holder may be extracted from the block bore by wedging a tool between the inclined recess top surface and the shoulder surface of the support block.

Further objects and advantages of this invention will be apparent from the following description, reference being had to the accompanying drawings in which one embodiment of the present invention is shown.

BRIEF DESCRIPTION OF DRAWINGS

While an embodiment of the invention is illustrated, the particular embodiment shown should not be construed to limit the claims. It is anticipated that various changes and modifications may be made, and that various embodiments may be employed, without departing from the scope of this patent.

BEST MODE FOR CARRYING OUT THE INVENTION

Figure 1:
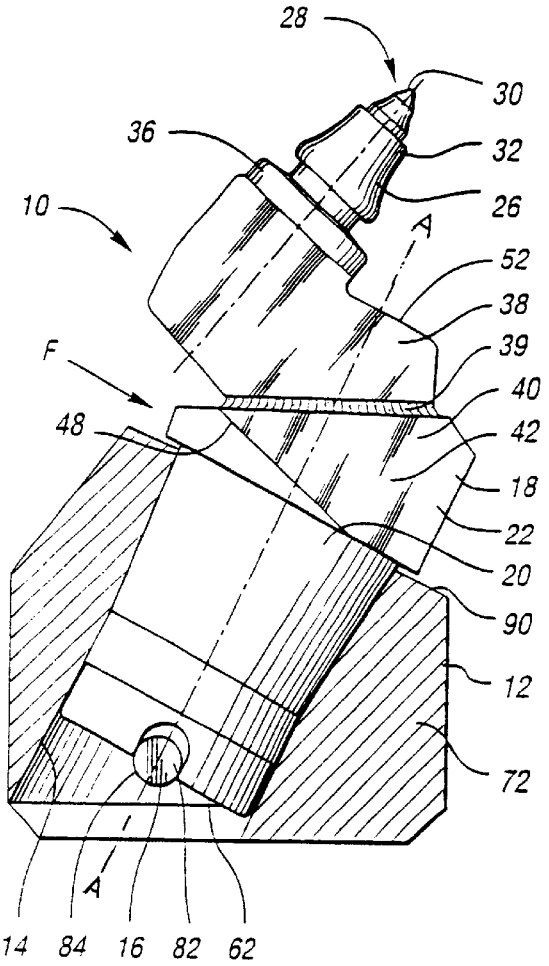
FIG. 1 is a side view of a support block in cross section and a cutting tool holder showing one embodiment of the invention.
Figure 2:
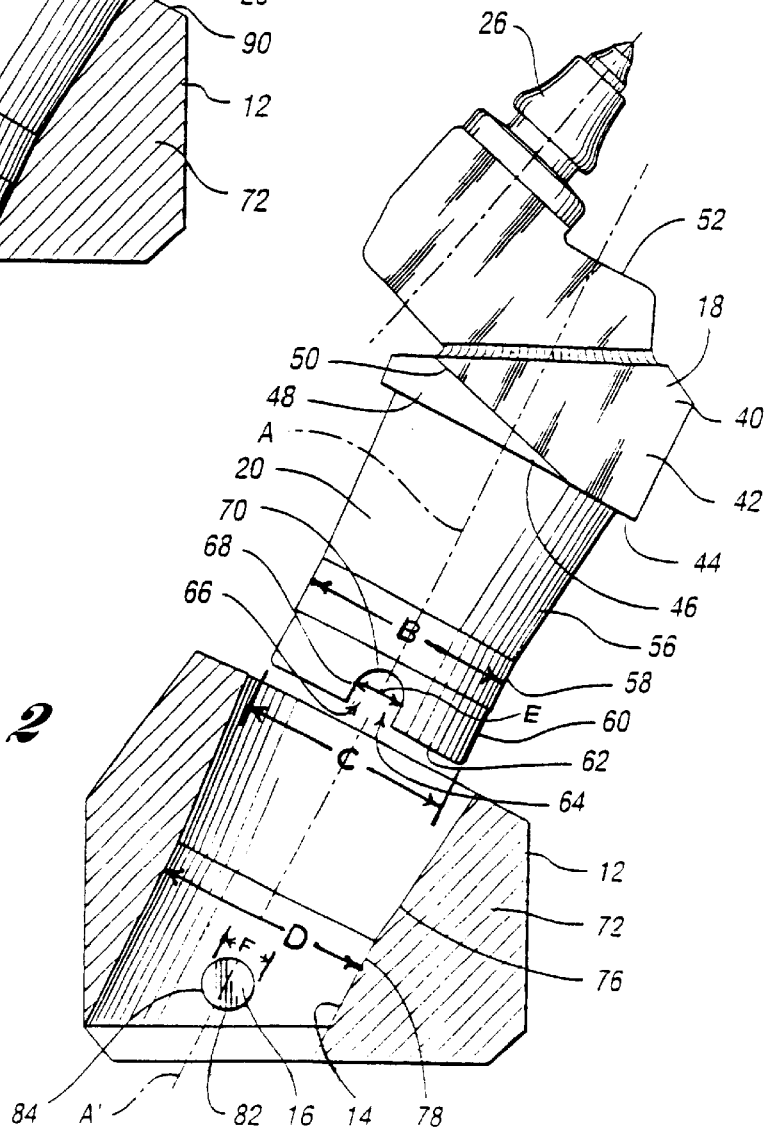
FIG. 2 is an exploded view of the embodiment shown in FIG. 1.

One embodiment of a cutting tool holder assembly 10 is shown in FIGS. 1 and 2. The cutting tool holder assembly 10 includes a support block 12 having a block bore 14 and a block engager 16. The cutting tool holder assembly 10 further includes a cutting tool holder 18 having a holder shank 20 joined to a holder body portion 22. In the embodiment shown, a cutting tool 26 may be rotatably and releasably mounted within the cutting tool holder 18. However, the scope of this patent would cover cutting tool holder assemblies in which the cutting tool is mounted to the cutting tool holder in any manner, non-rotatably or otherwise.

In use, such support blocks 12 can be distributed over and fastened to, such as by welding or any other suitable method, the circumference and length of a drum or other body (not shown) according to any desired pattern. The drum or other body may be driven by any conventional or suitable power means to cause the cutting tools 26 to engage and break up material that they are applied to. Such applications are well known in the art, and will not be described in further detail here.

The cutting tool 26 typically has an elongated body. A cutting end 28 typically comprises a hard cutting insert 30 mounted onto a generally conical outer region 32. The hard cutting insert 30 may be made from cemented tungsten carbide or any other suitable material. The hard cutting insert 30 is generally mounted at the end of the conical outer region 32 where the hard cutting insert 30 may be brazed or otherwise suitably fastened into place. The cutting tool 26 also typically includes a cutting tool shank 34 (not shown) adjoining a cutting tool shoulder 36 of the conical outer region 32. Because such cutting tools are generally known in the art, they need not be described in further detail here.

Cutting tool holders may have a variety of configurations. As shown in the embodiment depicted in FIGS. 1 and 2, the cutting tool holder 18 has a holder block portion 38 connected to a holder pedestal portion 40. The holder block portion 38 and the holder pedestal portion 40 may be connected together in any suitable manner, such as by welding 39. Because such separate holder block portions and holder pedestal portions are well known in the art, and the methods of connecting such portions are also well known in the art, they will not be described in further detail here.

In this embodiment, the holder block portion 38 defines a tool bore within which the cutting tool 26, typically the shank 34 (not shown) of the cutting tool 26, may be mounted. The holder pedestal portion 40 has a pedestal body portion 41 and also defines the holder shank 20 of the cutting tool holder 18 and, in this embodiment, a holder shoulder 44. The holder shank 20 is aligned along a center axis "A."

In this embodiment, the holder body portion 22 consists of the holder block portion 38 together with the pedestal body portion 42, that portion of the holder pedestal portion 40 not including the holder shank 20. While not shown, cutting tool holders may also have a unitary one-piece construction instead of the separate holder block and holder pedestal portion shown in the embodiment illustrated. In such case, the holder body portion would be that portion of the cutting tool holder not including the holder shank.

In the embodiment shown, the holder shoulder 44 has a shoulder face 46 located adjacent the support block 12 when the cutting tool holder 18 is assembled with the support block 12 as shown in FIG. 1. As shown in FIGS. 1 and 2, a portion of the holder shoulder face 46 is recessed so as to define an undercut recess 48. In this embodiment, the undercut recess 48 has a recess top surface 50. The recess top surface 50 in this embodiment is inclined relative to the holder shoulder face 46. A similar recess was disclosed in a patent application, hereby incorporated by reference in its entirety, entitled "Cutting Bit Support Member With Undercut Flange For Removal," having U.S. Ser. No. 09/166,634, and naming Kenneth J. Topka Jr. and Robert H. Montgomery, Jr. as the inventors.

The holder body portion 22 of the cutting tool holder 18, in this case the holder block portion 38, also has a striking surface 52. In a preferred embodiment, the striking surface 52 is substantially perpendicular to the center axis "A" of the holder shank 20 so that when struck by another object (not shown), such as a hammer, force will be directed along the center axis "A."

While the holder shank 20 of the cutting tool holder 18 may have a variety of configurations, the holder shank 20 as shown in this embodiment has a shank frusto-conically tapered locking portion 56, a shank press fit portion 58, a shank slip fit portion 60, and a shank bottom end 62. In this embodiment, the shank frusto-conically tapered portion 56 is tapered along the center axis "A." The shank press fit portion 58 is a cylindrical portion about the center axis "A" and has a shank press fit portion dimension, in this embodiment a shank press fit portion diameter "B."

The shank slip fit portion 60 is also cylindrical about the center axis "A," and has a slip fit portion dimension, in this case a slip fit portion diameter "C." In this embodiment, the slip fit portion dimension, the slip fit diameter "C," is less than the press fit portion dimension, the press fit portion diameter "B," of the shank press fit portion 58.

The shank bottom end 62 defines a tool holder locator 64 which, in the embodiment shown, has a female configuration. More specifically, the tool holder locator in this embodiment is a locator groove 66 running completely across the shank bottom end. In this embodiment, the locator groove 66 is defined by groove side walls 68 substantially parallel to the center axis "A" and a semi-cylindrical groove wall 70. The groove side walls 68 are separated by a dimension As shown in FIGS. 1 and 2, the support block 12 has a block body 72. The block body 72 defines the holder shank bore 14 of the support block 12 which has a holder shank bore center axis "A'." Holder shank bore center axis "A'" coincides with the axis "A" of the holder shank 20 of the cutting tool holder 18 when the components are assembled as shown in FIG. 1. The holder shank bore 14 has a block bore frusto-conically tapered locking portion 76 and a block bore press fit portion 78. In this embodiment, the block bore frusto-conically tapered portion 76 is tapered along the center axis "A'." The block bore press fit portion 78 is a cylindrical portion about the center axis "A'" and has a bore press fit dimension, in this embodiment a diameter "D." The bore press fit portion dimension, the diameter "D" in this embodiment, is more than the slip fit portion dimension, the diameter "C" in this embodiment, of the shank slip fit portion 60. The bore press fit portion dimension, the diameter "D" in this embodiment, is also slightly less than the shank press fit portion dimension, the diameter "B" in this embodiment, of the shank press fit portion 58 such that the shank press fit portion 58 press fits, or interference fits, with the block bore press fit portion 78 of the block bore 14 when the components are assembled. While any suitable diameter difference could be employed, a diameter difference of 0.002" to 0.003" between diameters "D" and "B" is believed suitable when the support block 12 and the holder shank 20 are made from heat treated alloy steel.

The included angle of the block bore tapered portion 76 is substantially equal to the included angle of the shank tapered portion 56 of the holder shank 20. Accordingly, as shown in FIG. 1, when the cutting tool holder 18 is assembled with the support block 12, the shank tapered portion 56 of the holder shank 20 will seat within the block bore tapered portion 76 of the block bore 14. While any included angle could be used, an included angle in the range of 10° to 14° is believed suitable.

The block engager 16 may employ a variety of components and may have a variety of configurations. In the embodiment shown in FIGS. 1 and 2, the block engager 16 has a male configuration such that it will mate with the female configuration of the tool holder locator 64. More specifically, the block engager 16 of this embodiment is a block pin 82 while the tool holder locator 64 is a locator groove 66. In this embodiment, the block pin 82 is cylindrical in shape and the support block 12 includes pin bores 84 such that the block pin 82 may be assembled with the support block 12. One suitable method of assembly, if a suitable block pin is used, is to drive the block pin 82 into the pin bores 84. While any suitable block pin 82 may be used, a spring pin, a spiral pin, or a DRIV-LOK® pin may be used. The DRIV-LOK® pin is available through Applied Industrial Technology, 388 Industrial Park Road, Ebensburg, Pa. 15931. Such block pin 82 may be made from any suitable material, such as heat treated steel or spring steel. The block pin diameter "F" is slightly less than the dimension "E" between the groove side walls 68 of the locator groove 66 in the holder shank 20 such that the block pin 82 may be slipped into the locator groove 66 so as to orient the cutting tool holder 18 in any desired orientation relative to the support block 12. A block pin diameter "F" of ⅜" is believed suitable with a dimension "E" of 0.390" between the groove side walls 68.

To use the embodiment of this invention shown in FIGS. 1 and 2, the holder shank 20 of a cutting tool holder 18, with or without a cutting tool 26, may be loosely inserted into the block bore 14 of the support block 12. The shank slip fit portion 60, having a diameter "C" less than the diameter "D" of the block bore press fit portion 78, will aid in this assembly by allowing the shank slip fit portion 60 to slip fit into the block bore press fit portion 78.

The cutting tool holder 18 may then be rotated until the tool holder locator 64 of the holder shank 20 initially engages the block engager 16 of the support block 12.

At that point, the holder shank 20 of the cutting tool holder 18 may be pushed into the block bore 14 of the support block 12 until the shank tapered portion 56 of the holder shank 20 seats within the block bore tapered portion 76 of the block bore 14 and such that the shank press fit portion 58 of the holder shank 20 press fits with the block bore press fit portion 78 of the block bore 14. In the embodiment shown, this may be achieved by striking the striking surface 52 of the cutting tool holder 18.

As that is happening, the block engager 16 of the support block 12 will more fully engage with the tool holder locator 64 of the holder shank 20. In the embodiment shown in FIGS. 1 and 2, this is achieved by the block pin 82 of the support block 12 as it slides between the groove side walls 68 of the locator groove 66 of the shank bottom end 62 of the holder shank 20.

In order to extract the cutting tool holder 18 from the block bore 14 of the support block 12, the undercut recess 48 may be employed. For example, a suitable tool may be inserted into the undercut recess 48 and used to pry the holder shank 20 of the cutting tool holder 18 from the block bore 14 of the support block 12. However, in the embodiment shown, because the recess top surface 50 is inclined relative to the holder shoulder face 46 of the cutting tool holder 18, the cutting tool holder 18 may be extracted from the block bore 14 by inserting a wedging tool (not shown) in the direction illustrated by the arrow "G" in FIG. 1 so as to engage the inclined recess top surface 50 of the undercut recess 48 and the shoulder face 46 of the support block 12. The wedging tool may either be struck or other otherwise pushed in the direction "F" so as to impose, by way of wedging the shoulder face 46 and undercut recess 48 apart, an axial force along the axis "A" of the holder shank 20. This may be repeated until the shank press fit portion 58 of the holder shank 20 is disengaged from the block bore press fit portion 78 of the block bore 14. At that point, the cutting tool holder 18 could then be freely removed from the block bore 14 of the support block 12.

Operationally, most of the cutting loads from the cutting tool holder 18 would be transferred into the support block 12 through the seating of the shank tapered portion 56 of the holder shank 20 with the block bore tapered portion 76 of the block bore 14. In practice, this seating arrangement would normally remain tightly engaged due to the axial loads along the axis "A" imposed from the cutting tool 28 and cutting tool holder 18 into the support block 12 as the cutting tool engages and breaks up the material which is sought to be mined or removed.

The press fitting of the shank press fit portion 58 of the holder shank 20 with the block bore press fit portion 78 of the block bore 14 helps serve to prevent the cutting tool holder 18 from being accidentally disengaged from the support block 12 as a result of vibration, impact, or reverse loading of the excavation cutting tool holder assembly 10. Such reverse loading which may occur, for example, if the cutting tool assemblies 10 are used in conjunction with a drum and the machine carrying the drum is backed up without the drum rotating.

In a preferred embodiment, as shown in FIG. 1, a shoulder face 46 of the cutting tool holder 18 does not contact the support block 12. The remaining gap 90 may have any dimension. For example, the gap could be the range of 0.06 to 0.12 inches. By maintaining a gap, it is ensured that the shank tapered portion 56 seats firmly with the block bore tapered portion 76 when the components are assembled.

One advantage of this excavation cutting tool holder assembly is that no screws or lugs are required to assemble the cutting tool holder 18 with the support block 12. The cutting tool holder 18 can be simply pushed or knocked into, and pulled or knocked out of, a block bore 14 of the support block 12. A related advantage is that because the components are relatively simple in geometry, machining or milling costs typically associated with the manufacture of such components are less than typical.

Another advantage of embodiments of this excavation cutting tool holder assembly having shank and block bore tapered portions, 76 and 56 respectively, is that when the shank tapered portion 56 is seated within the block bore tapered portion 76, the resulting "locking taper" will normally remain tightly engaged due to the cutting loads imposed in a direction from the cutting tool 26 to the support block 12 which will occur during normal use.

Yet another advantage, previously noted, is that in embodiments including press fit portions the press fit between the cutting tool holder 18 and the block bore 14 prevents the cutting tool holder 18 from being accidentally dislodged from the support block 12 as a result of machine vibration, impact, or reverse loading.

Yet another advantage in embodiments including a striking surface is that the striking surface 52 of the cutting tool holder 18 allows the cutting tool holder 18 to be struck to mount the holder shank 20 within the block bore 14.

As previously explained, another related advantage in embodiments including an undercut recess is that the undercut recess 48 allows the cutting tool holder 18 to be easily removed from the block bore 14 of the support block 12.

While a particular embodiment of the invention has been illustrated and described, it will be obvious to those skilled in the art that various changes and modifications may be made, and other embodiments utilized, without departing from the scope of this patent. For example, while in the embodiment shown the shank and block bore tapered portions are located adjacent the holder body portion, and the shank and block bore press fit portions are then located adjacent the shank and block bore tapered portions, a reverse arrangement, while not shown, could be utilized. More specifically, the shank and block bore press fit portions could be located adjacent the holder body portion while the shank and block bore tapered portions could then be located adjacent the shank and block bore press fit portions. As another example, while in the embodiment shown the tool holder locator has a female configuration and the block engagor has a male configuration, the opposite could also be utilized. In such case, the tool holder locator would have a male configuration while the block engagor would have a female configuration. It is intended that the following claims cover all such modifications and embodiments, and all other modifications and embodiments, and all equivalents of such modifications and embodiments, that fall within the spirit of this invention.

What is claimed is:

1. An excavation cutting tool holder assembly comprising:

a cutting tool holder having a holder body portion and a holder shank, the holder shank having a shank press fit portion and a shank bottom end, the shank press fit portion having a shank press fit dimension and the shank bottom end having a tool holder locator; and a support block having a block body, the block body having a block bore, the block bore having a block bore press fit portion and a block engagor, the block bore press fit portion having a block bore press fit dimension less than the shank press fit dimension such that the shank press fit portion press fits with the block bore press fit portion while the block engagor engages the tool holder locator so as to orient the cutting tool holder relative to the support block wherein the shank press fit portion is a shank cylindrical portion having a shank press fit diameter and the bore press fit portion is a bore cylindrical portion having a block bore press fit diameter less than the shank press fit diameter.

2. The excavation cutting tool holder assembly of claim 1 wherein the tool holder locator has a female configuration and the block engagor has a male configuration.

3. The excavation cutting tool holder assembly of claim 1 wherein the block engagor is a block pin within the block bore and the tool holder locator is a locator groove in the shank bottom end such that the block pin will engage with and slide into the locator groove so as to orient the cutting tool holder relative to the support block.

4. The excavation cutting tool holder assembly of claim 3 wherein the block bore has a block bore width and the shank bottom end has a shank bottom end width, the block pin is a cylindrical pin running across the entire block bore width and the locator groove has groove side walls running across the entire shank bottom end width.

5. The excavation cutting tool holder assembly of claim 1 wherein the holder body portion of the cutting tool holder has a holder shoulder, the holder shoulder having a holder shoulder face located adjacent the block body when the cutting tool holder is press fit within the block bore of the support block, the holder shoulder face defining an undercut recess.

6. The excavation cutting tool holder assembly of claim 5 wherein the undercut recess has a top recess surface which is inclined relative to the holder shoulder face.

7. The excavation cutting tool holder assembly of claim 1 wherein the holder shank has a shank slip fit portion to guide the holder shank into the block bore.

8. The excavation cutting tool holder assembly of claim 1 wherein the shank has a shank tapered portion and the block bore has a block bore tapered portion such that when the shank tapered portion seats within the block bore tapered portion the shank press fit portion press fits with the block bore press fit portion.

9. The excavation cutting tool holder assembly of claim 8 wherein the shank tapered portion is located adjacent the holder body portion and the shank press fit portion is located adjacent the shank tapered portion.

10. The excavation cutting tool holder assembly of claim 8 wherein the holder shank has shank slip fit portion to guide the holder shank into the block bore.

11. The excavation cutting tool holder assembly of claim 10 wherein the shank tapered portion is located adjacent the holder body portion, the shank press fit portion is located adjacent the shank tapered portion, and the shank slip fit portion is located adjacent the shank press fit portion.

12. The excavation cutting tool holder assembly of claim 1 wherein the block engagor is a pin within the block bore and the tool holder locator is a locator groove in the shank bottom end such that the block pin will engage the locator groove so as to orient the cutting tool holder relative to the support block such that the block pin will slide into the locator groove as the cutting tool holder is press fit with the support block.

13. The excavation cutting tool holder assembly of claim 1 wherein the cutting tool holder includes a striking surface.

14. An excavation cutting tool holder assembly comprising:

a cutting tool holder having a holder body portion and a shank, the holder shank having a shank tapered portion and a shank press fit portion, the shank press fit portion having a shank press fit dimension; and a support block having a block body, the block body having a block bore, the block bore having a block bore tapered portion and a block bore press fit portion, the block bore press fit portion having a block press fit diameter less than the holder press fit diameter such that when the shank tapered portion seats within the block bore tapered portion the shank press fit portion press fits with the block bore press fit portion wherein the shank press fit portion is a shank cylindrical portion having a shank press fit diameter and the block bore press fit portion is a block bore cylindrical portion having a block bore press fit diameter less than the shank press fit diameter such that the shank cylindrical portion press fits with the block bore cylindrical portion of the block bore.

15. The excavation cutting tool holder assembly of claim 14 wherein the holder shank has a shank bottom end having a locator groove and the block bore has a block pin such that the block pin will engage with and slide into the locator groove so as to orient the cutting tool holder relative to the support block.

16. The excavation cutting tool holder assembly of claim 14 wherein the holder body portion of the cutting tool holder has a holder shoulder, the holder shoulder having a holder shoulder face located adjacent the block body when the cutting tool holder is press fit within the block bore of the support block, the holder shoulder face defining an undercut recess.

17. The excavation cutting tool holder assembly of claim 16 wherein the undercut recess has a top recess surface which is inclined relative to the holder shoulder face.

18. The excavation cutting tool holder assembly of claim 14 wherein the holder shank has a shank slip fit portion to guide the holder shank into the block bore.

19. The excavation cutting tool holder assembly of claim 14 wherein the shank tapered portion is located adjacent the holder body portion, and the shank press fit portion is located adjacent the shank tapered portion.

20. The excavation cutting tool holder assembly of claim 14 wherein the cutting tool holder has a striking surface.

21. An excavation cutting toolholder assembly comprising:

a cutting tool holder having a holder body portion and a holder shank, the holder shank having a shank tapered portion and a holder shoulder having a holder shoulder face, the holder shoulder face defining an undercut recess;

a support block having a block body, the block body having a block bore, the block bore having a block bore tapered portion such that the shank tapered portion seats within the block bore tapered portion and the holder shoulder face is correspondingly located adjacent the block body.

22. The excavation cutting tool holder assembly of claim 21 wherein the holder shank has a shank bottom end having a tool holder locator and the block bore has a block engagor which engages the tool holder locator so as to orient the cutting tool holder relative to the support block.

23. The excavation cutting tool holder assembly of claim 22 wherein the tool holder locator is a locator groove and the block engagor is a block pin.

24. The excavation cutting tool holder assembly of claim 21 wherein the undercut recess has a top recess surface which is inclined relative to the holder shoulder face.

25. The excavation cutting tool holder assembly of claim 21 wherein the holder shank has a shank slip fit portion to guide the holder shank into the block bore.

26. The excavation cutting tool holder assembly of claim 21 wherein the cutting tool holder has a striking surface.

27. The excavation cutting tool holder assembly of claim 21 wherein the holder shank has a press fit portion and the block bore has a block bore press fit portion such that the shank press fit portion press fits with the block bore press fit portion when the shank tapered portion seats within the block bore tapered portion.

28. A cutting tool holder for use with a support block having a block body, the block body having a block bore, the block bore having a block bore tapered portion, a block bore cylindrical press fit portion, and a block engagor, the block bore press fit portion having a block bore press fit diameter, the cutting tool holder comprising:

a holder body portion; and a holder shank having a shank tapered portion, a shank cylindrical press fit portion, and a shank bottom end, the shank press fit portion having a shank press fit diameter and the shank bottom end having a tool holder locator, the shank press fit diameter being greater than the bore press fit diameter such that the shank press fit portion press fits with the bore press fit portion while the shank tapered portion seats within the block bore tapered portion and the block engagor engages the tool holder locator so as to orient the cutting tool holder relative to the support block.

29. The cutting tool holder of claim 28 wherein the tool holder locator is a locator groove.

30. The cutting tool holder of claim 28 wherein the holder body portion has a holder shoulder, the holder shoulder having a holder shoulder face located adjacent the block body when the cutting tool holder is press fit within the block bore of the support block, the holder shoulder face defining an undercut recess, the undercut recess having a top recess surface which is inclined relative to the holder shoulder face.

31. The cutting tool holder of claim 28 wherein the cutting tool holder includes a striking surface.

32. A support block for use with a cutting tool holder having a holder body portion and a shank, the shank having a shank tapered portion, a shank cylindrical press fit portion, and a shank bottom end, the shank press fit portion having a shank press fit diameter and the shank bottom end having a tool holder locator, the support block comprising:

a block body having a block bore, the block bore having a block bore tapered portion, a block bore cylindrical press fit portion, and a block engagor, the bore press fit portion having a bore press fit diameter less than the shank press fit diameter such that the shank tapered portion seats within the block bore tapered portion, the shank press fit portion press fits with the bore press fit portion, and the block engagor engages the tool holder locator so as to orient the cutting tool holder relative to the support block.

33. The support block of claim 32 wherein the block engagor is a block pin.

34. A holder pedestal portion for use with a holder block portion and a support block, the support block having a block body, the block body having a block bore, the block bore having a block bore tapered portion, a block bore cylindrical press fit portion, and a block engagor, the block bore press fit portion having a block bore press fit diameter, the holder pedestal portion comprising:

a pedestal body portion connectable to the holder block portion; and a holder shank having a shank tapered portion, a shank cylindrical press fit portion, and a shank bottom end, the shank press fit portion having a shank press fit diameter and the shank bottom end having a tool holder locator, the shank press fit diameter being greater than the bore press fit diameter such that the shank press fit portion press fits with the bore press fit portion while the shank tapered portion seats within the block bore tapered portion and the block engagor engages the tool holder locator so as to orient the cutting tool holder relative to the support block.

35. The holder pedestal portion of claim 34 wherein the tool holder locator is a locator groove.

36. The holder pedestal portion of claim 34 wherein the pedestal body portion has a holder shoulder, the holder shoulder having a holder shoulder face located adjacent the block body when the holder shank of the holder pedestal portion is press fit within the block bore of the support block, the holder shoulder face defining an undercut recess, the undercut recess having a top recess surface which is inclined relative to the holder shoulder face.

37. The holder pedestal portion of claim 34 wherein the pedestal body portion includes a striking surface.

38. An excavation cutting tool holder assembly comprising:

a cutting tool holder having a holder body portion and a shank, the holder shank having a shank generally frusto-conically tapered portion and a cylindrical shank press fit portion, the shank press fit portion having a shank press fit dimension; and a support block having a block body, the block body having a block bore, the block bore having a block bore generally frusto-conically tapered portion and a block bore generally cylindrical press fit portion, the block, bore press fit portion having a block press fit dimension less than the holder press fit dimension such that when the shank frusto-conically tapered portion seats within the block bore frusto-conically tapered portion the shank press fit portion press fits with the block bore press fit portion wherein the shank press fit portion is a shank cylindrical portion having a shank press fit diameter and the block bore press fit portion is a block bore cylindrical portion having a block bore press fit diameter less than the shank press fit diameter.

39. An excavation cutting toolholder assembly comprising:

a cutting tool holder having a holder body portion and a holder shank, the holder shank having a generally frusto-conically tapered portion and a holder shoulder having a holder shoulder face, the holder shoulder face defining an undercut recess;

a support block having a block body, the block body having a block bore, the block bore having a block bore generally frusto-conically tapered portion such that the shank frusto-conically tapered portion seats within the block bore frusto-conically tapered portion and the holder shoulder face is correspondingly located adjacent the block body.

40. An excavation cutting tool holder assembly comprising:

a cutting tool holder having a holder body portion and a shank, the holder shank having a shank generally frusto-conically tapered portion and a shank press fit portion, the shank press fit portion having a shank press fit dimension; and a support block having a block body, the block body having a block bore, the block bore having a block bore generally frusto-conically tapered portion and a block bore press fit portion, the block bore press fit portion having a block press fit dimension less than the holder press fit dimension such that when the shank frusto-conically tapered portion seats within the block bore frusto-conically tapered portion the shank press fit portion press fits with the block bore press fit portion.

* * * * *